US005200721A

United States Patent [19]

Mansour

[11] Patent Number: 5,200,721

[45] Date of Patent: Apr. 6, 1993

[54] DUAL-MODE FILTERS USING DIELECTRIC RESONATORS WITH APERTURES

[75] Inventor: Raafat R. Mansour, Waterloo, Canada

[73] Assignee: Com Dev Ltd., Cambridge, Canada

[21] Appl. No.: 794,044

[22] Filed: Nov. 19, 1991

[30] Foreign Application Priority Data

Aug. 2, 1991 [CA] Canada ..... 2048404

[51] Int. Cl.[5] ..... H01P 1/20; H01P 7/10

[52] U.S. Cl. ..... 333/202; 333/219.1; 333/212

[58] Field of Search ..... 333/202, 208-212, 333/219.1, 219, 235, 234, 227, 228

[56] References Cited

U.S. PATENT DOCUMENTS

| | | | |
|---|---|---|---|
| 4,028,652 | 6/1977 | Wakino et al. | 333/209 |
| 4,630,012 | 12/1986 | Fuller et al. | 333/235 |
| 4,652,843 | 3/1987 | Tang et al. | 333/212 |
| 4,706,052 | 11/1987 | Hattori et al. | 333/219.1 |
| 5,059,929 | 10/1991 | Tanaka | 333/219.1 |

FOREIGN PATENT DOCUMENTS

| | | | |
|---|---|---|---|
| 0039042 | 4/1978 | Japan | 333/235 |

OTHER PUBLICATIONS

Zaki et al. "New Results in Dielectric-Loaded Resonators", IEEE Trans. on Microwave Theory & Tech. vol. MTT-34, No. 7, Jul. 1986, pp. 815-824.

*Primary Examiner*—Paul M. Dzierzynski
*Assistant Examiner*—Seung Ham
*Attorney, Agent, or Firm*—Daryl W. Schnurr

[57] ABSTRACT

A dual-mode filter has a dielectric resonator in each cavity, with each resonator containing one or more apertures. The aperture or apertures are located to shift a resonance frequency of a spurious mode to a higher frequency range distance from a principal mode. The principal mode can be an $HEH_{11}$ mode and the spurious mode can be an $HEE_{11}$ mode or vice-versa. The dielectric resonators can be a solid block or two or more discs that are laminated to one another. Previous dual-mode filters cannot attain the results required for current satellite systems.

16 Claims, 10 Drawing Sheets

DUAL-MODE FILTERS USING DIELECTRIC RESONATORS WITH APERTURES

BACKGROUND OF THE INVENTION

1. Field of the Invention

This invention relates to dual-mode filters and particularly to dual-mode filters having dielectric resonators containing apertures.

2. Description of the Prior Art

Dual-mode dielectric resonator filters have been widely used in cellular radios and satellite multiplexers. Although, the use of dielectric resonator technology offers a significant reduction in weight and size in comparison with the waveguide resonator technology, it is known that the spurious performance of dual-mode dielectric resonator filters is not satisfactory for many satellite applications. In satellite multiplexers, improving the spurious performance of such filters will readily translate to higher communication capacity, or cost saving, or further reduction in weight and size or a combination of these factors.

Implementation of dual-mode dielectric resonator filters has been conventionally accomplished by using the resonator configuration shown in FIG. 1, where a solid cylindrical dielectric resonator R, housed within a metallic enclosure M, operates in either the dual $HEH_{11}$ mode or the dual $HEE_{11}$ mode. It is also known that the proximity of the resonant frequency of the $HEE_{11}$ mode to that of the $HEH_{11}$ mode interferes with the filter performance causing undesirable spurious response.

The resonant characteristics of the conventional resonator shown in FIG. 1 have been described by K. A. Zaki and C. Chen (IEEE, MTT-34, No. 7, pp. 815–824). A typical mode chart for this resonator is illustrated in FIG. 2 in which the abscissa and ordinate represent the diameter to height ratio and the resonant frequency of the first four modes. Although the location of the spurious response can be controlled by adjusting the resonator dimensions, even with the choice of the optimum dimensions the attainable spurious separation is not adequate to meet the stringent requirements of recent satellite systems. A need has therefore arisen for a dual-mode dielectric resonator with improved spurious performance.

U.S. Pat. No. 4,028,652 issued June, 1977 to K. Wakino, et al. describes a single mode filter having a dielectric resonator containing one or more apertures. Undesirable spurious responses are said to be reduced. The patent does not however suggest the use of dual-mode operation of any of the described resonant structures.

U.S. Pat. No. 4,706,052 issued November, 1987 to Jun Hiattori, et al. describes a single-mode filter design in which a variety of differently shaped, layered and dimensioned dielectric resonators are disclosed and described. While the resonators do not contain apertures, the stated purpose of the invention is to improve the spurious performance of single-mode dielectric resonators operating in the $TEH_{01}$ mode. There is no suggestion to use dual-mode operation.

SUMMARY OF THE INVENTION

An object of the present invention is the provision of a dual-mode filter having dielectric resonator structure operating either in the dual $HEH_{11}$ mode or the dual $HEE_{11}$ mode, said filter having a remarkable improved spurious performance as compared to prior art.

Another object of the present invention is the provision of a dual-mode filter having a dielectric resonator structure in which the improvement of the spurious performance can be achieved with a simple and reduced weight construction.

A dual-mode filter has at least one cavity resonating in a dual-mode. The at least one cavity contains a dielectric resonator. The resonator contains at least one aperture and the at least one aperture extends partially through said resonator and is sized and located to shift a resonance frequency of a spurious mode to a higher frequency range distance from a principal mode.

The foregoing and other objects and advantages of the invention will become apparent from the following description. In the description, reference is made to the accompanying drawings which form a part hereof and in which there is shown by way of illustration a preferred embodiment of the invention.

DESCRIPTION OF A PREFERRED EMBODIMENT

Figure 1:
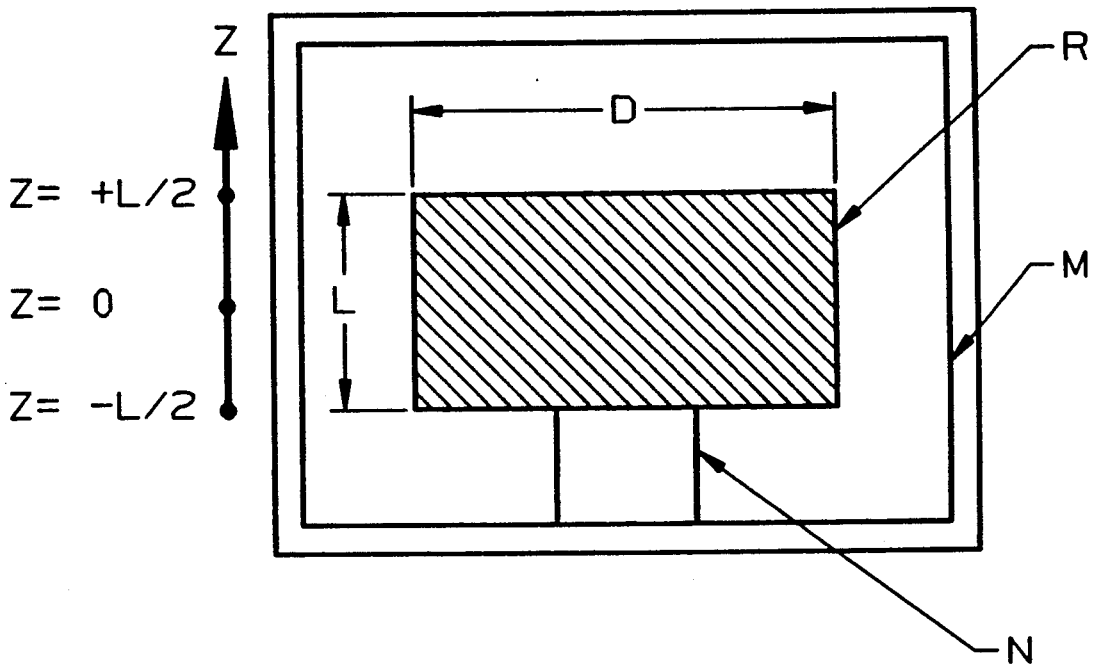
PRIOR ART FIGURE 1
FIG. 1 is a side elevation view of a prior art dielectric resonator.

In FIG. 1, there is shown a prior art dielectric resonator R supported on a support N and enclosed in a metal casing M. The resonator R has a diameter D and a length L.

Figure 2:
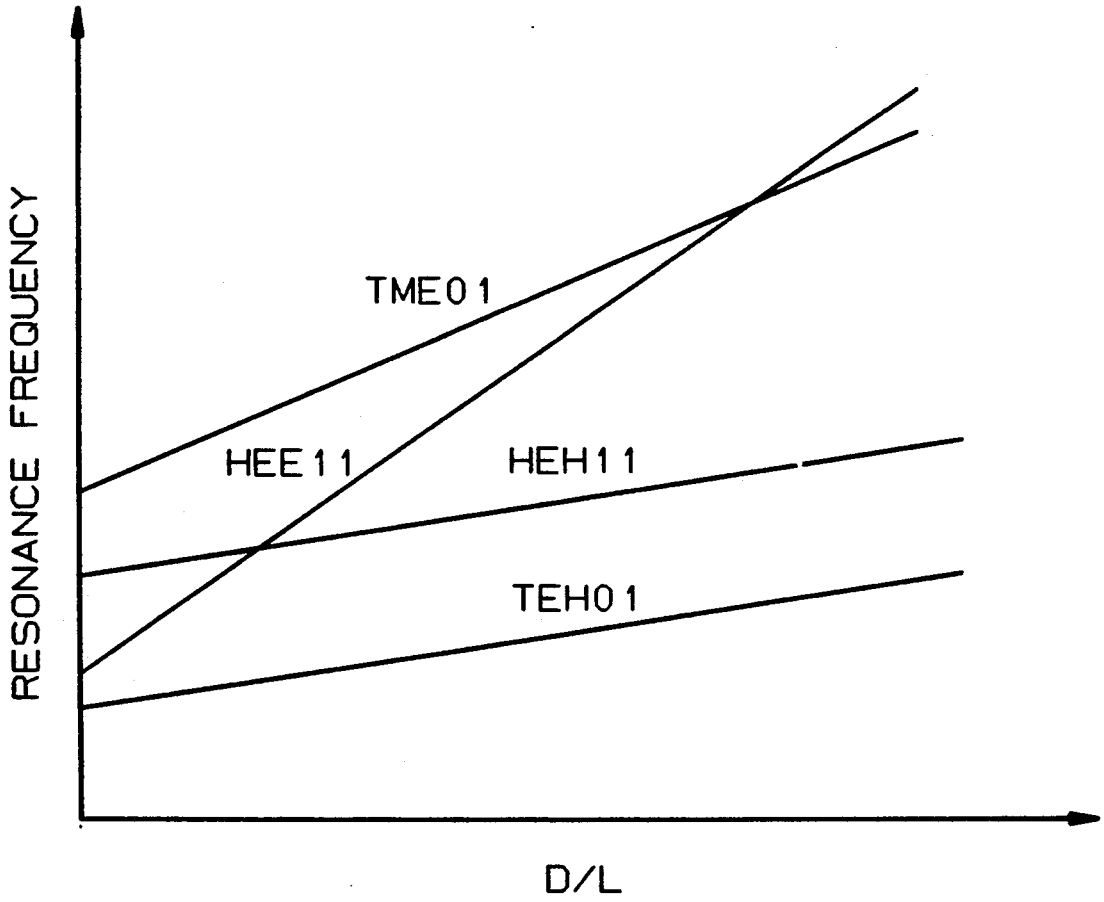
FIG. 2 is a graph illustrating a typical mode chart for the prior art resonator shown in FIG. 1.

In FIG. 2, there is shown a graph of the resonance frequency of a cavity of a dual-mode filter containing the resonator R from FIG. 1 when measured against the ratio of diameter divided by length for various different modes.

Figure 3:
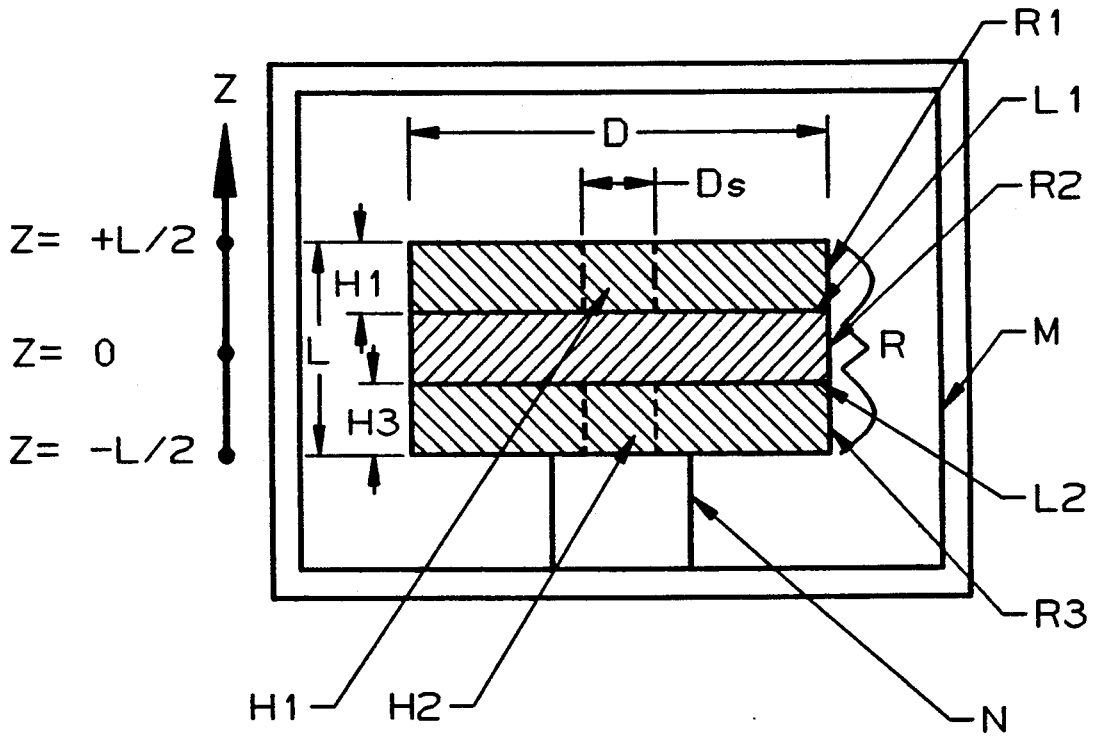
FIG. 3 is a partial sectional side view of one embodiment of a dielectric resonator according to the present invention.
Figure 4:
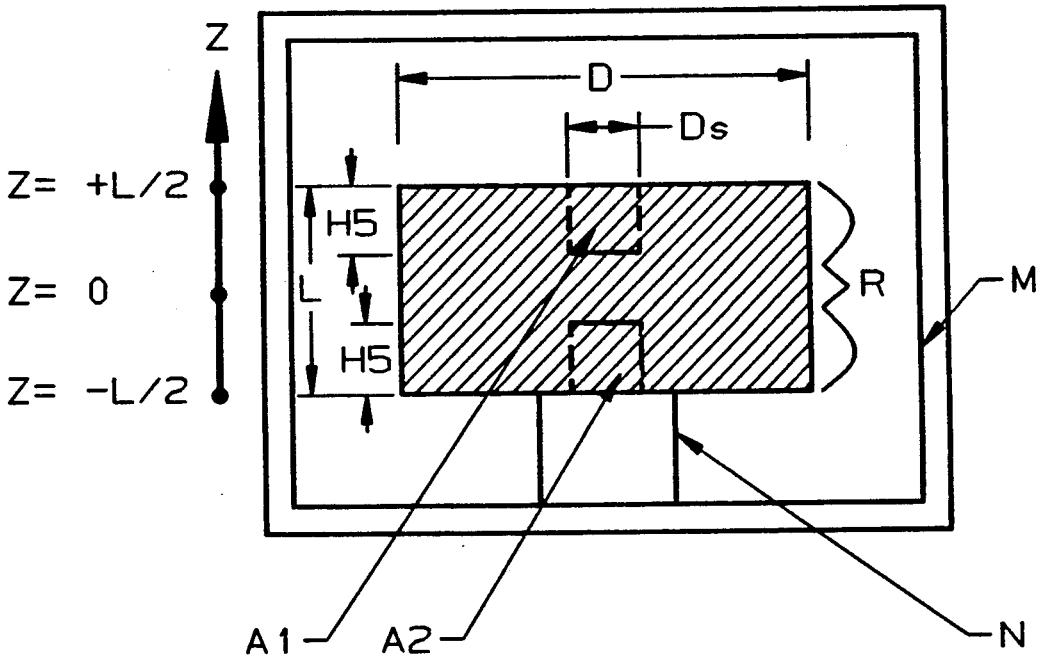
FIG. 4 is a partial sectional side view of another embodiment of a resonator according to the present invention.

FIGS. 3 and 4 show two embodiments of the present invention employing a dielectric resonator structure operating in the $HEH_{11}$ mode, whereby the resonant frequency of the spurious $HEE_{11}$ mode is shifted into a higher frequency zone. In FIG. 3, there is shown a solid dielectric disc $R_2$ sandwiched between two other discs $R_1$ and $R_3$ having through apertures $H_1$ and $H_2$ in a centre. The three discs $R_1$, $R_2$, $R_3$ have the same diameter and are attached together by a bonding material, for example, TRANSBOND (a trade mark). Since bonding layers $L_1$ and $L_2$ are located away from a center (z=0) where the electric field intensity of the $HEH_{11}$ mode is high, the unloaded Q of the resonator is little affected by the loss tangent of the bonding material.

In FIG. 4, there is shown a dielectric resonator similar to that shown in FIG. 3 where two blind apertures $A_1$ and $A_2$ are machined into a solid cylindrical resonator R. It is to be noted that the apertures $A_1$ and $A_2$ may have cylindrical or any desired shape. The said apertures may be partially or totally filled with another dielectric material with a dielectric constant lower than that of the dielectric resonator. Each of the dielectric resonators shown in FIGS. 3 and 4 is mounted on a support N inside a metallic enclosure M. The supports can be made of low loss dielectric constant material, for example, REXOLITE (a trade mark), quartz or MURATA Z (a trade mark). The metallic enclosure can have cylindrical, square or any other desired shape, as long as it provides shielding around the described resonator.

Figure 5:
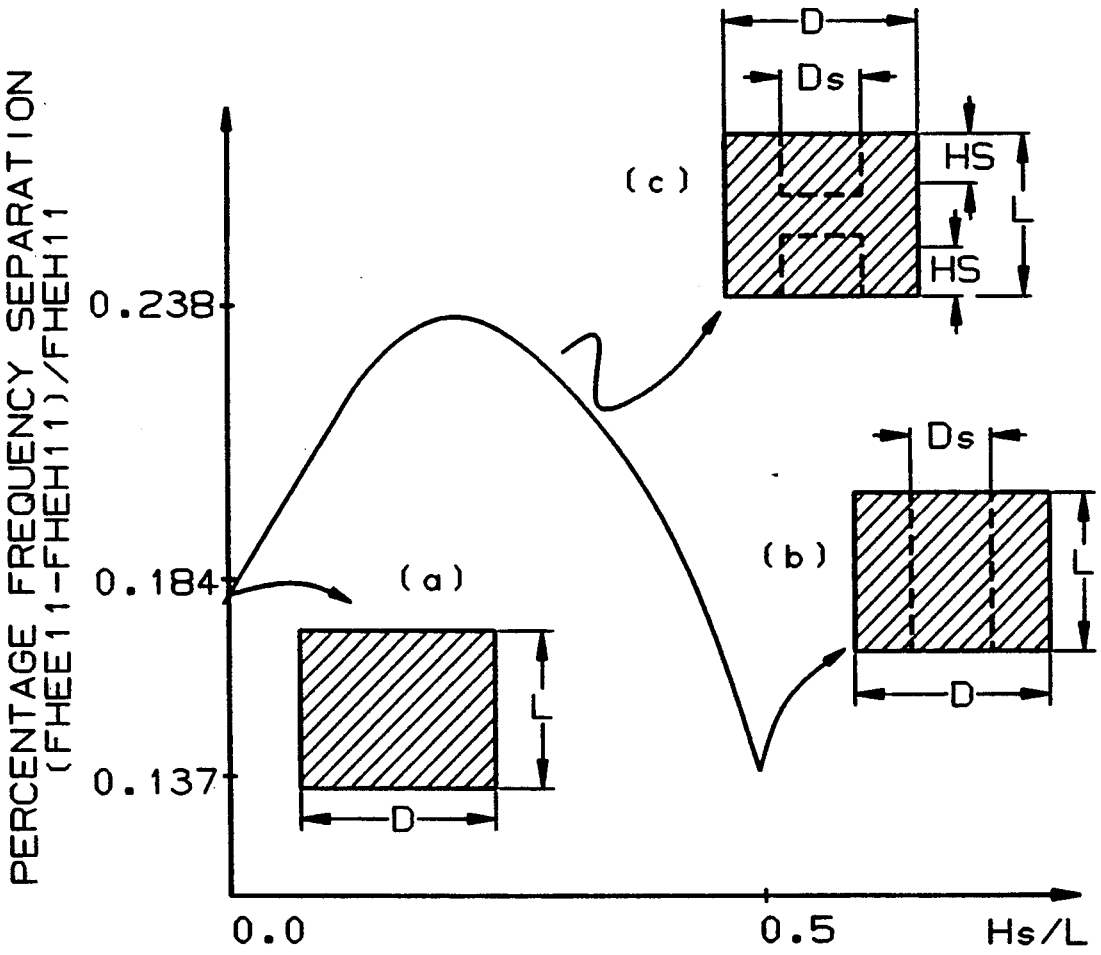
FIG. 5 is a graph illustrating the resonant characteristics of the dielectric resonator configurations shown.

By way of example, the resonant characteristics of a resonator of the type shown in FIG. 4 with a diameter D=17.8 mm, height L=5.8 mm and aperture diameter Ds=4.0 mm, is measured for different values of aperture depth Hs. For the given D/L ratio, the first three consecutive resonant modes are $TEH_{01}$, $HEH_{11}$ and $HEE_{11}$. FIG. 5 shows the percentage frequency separation $(f_{HEE11}-f_{HEH11})/f_{HEH11}$ between the operating mode $HEH_{11}$ and the spurious mode $HEE_{11}$ versus the ratio Hs/L. The values given at Hs/L=0.0 and Hs/L=0.5 represent respectively the percentage spurious separation exhibited by the conventional solid dielectric resonator and by a dielectric resonator in a coaxial cylindrical form. It can be seen that the resonator configuration described in FIG. 4 offers a 30% improvement in the percentage frequency separation over that exhibited by the prior art solid resonator shown in FIG. 1. Since the electric field intensity of $TEH_{01}$ and $HEH_{11}$ modes is minimum at $z=+\frac{1}{2}$, the provision of shallow apertures $A_1$ and $A_3$ at the top and bottom faces has a negligible effect on the resonance frequencies of these two modes, and consequently on the frequency separation between them. It is to be also noted that for a given diameter D, height L and aperture depth Hs, the frequency separation between the $HEH_{11}$ mode and the $HEE_{11}$ mode is controlled by the aperture diameter Ds. An improvement in the frequency separation of more than 30% can be achieved by the choice of the optimum values of Ds and Hs.

Figure 6:
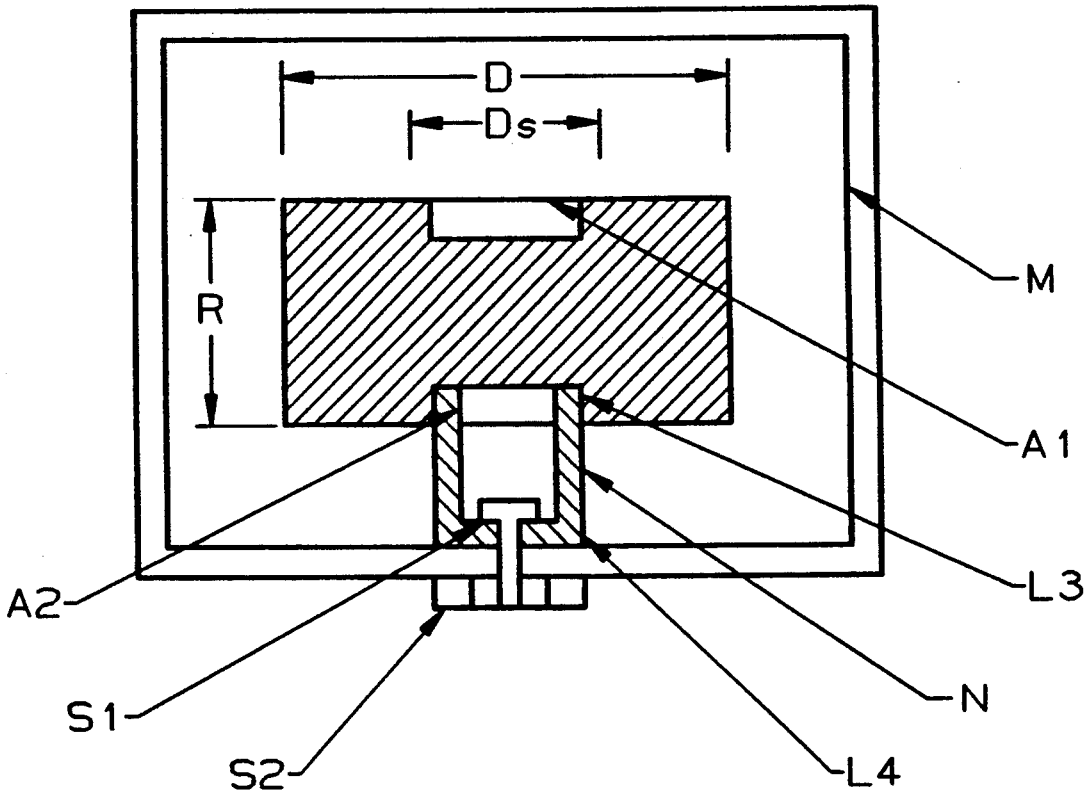
FIG. 6 is a partial sectional side view illustrating a support for a dielectric resonator inside a metallic enclosure.

FIG. 6 illustrates a support for the dielectric resonators inside the metallic enclosure M. A support in cup-form N is fitted into the aperture $A_2$, and is bonded to the dielectric resonator by an adhesive material. The support is screwed to the metallic enclosure using a plastic screw $S_1$ and a blind nut $S_2$. There is a layer $L_4$ of pliable adhesive, for example, scotechweld between the base of the support and the enclosure body which acts as vibration damping material and adds extra strength. This support configuration provides mechanical integrity, minimizes Q degradation and guarantees design repeatability with accurate placement of the dielectric resonator.

Figure 7:
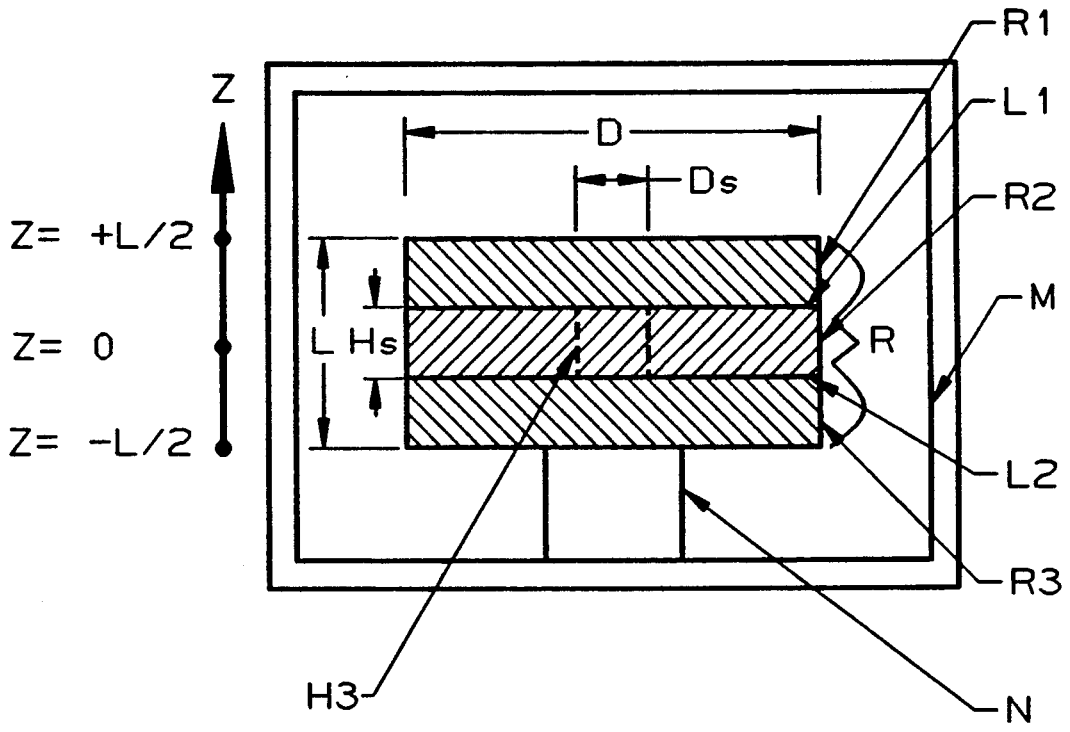
FIG. 7 is a partial sectional side view of a dielectric resonator having three discs with an aperture in a centre disc.

In FIG. 7, there is shown a further embodiment of the present invention whereby the basic mode of operation is the $HEE_{11}$ mode. The resonator described in FIG. 6 has three dielectric discs $R_1$, $R_2$, $R_3$, all having the same diameter and being attached together by a bonding material. The middle disc $R_2$ has a through aperture $H_3$ in a center. The aperture $H_3$ may have a cylindrical shape or any other desired shape. This disc deforms the fields of the $HEH_{11}$ mode causing its resonance frequency to be shifted into a higher frequency range while negligibly affecting that of the operating $HEE_{11}$ mode. Since the discs are bonded close to the resonator center (z=0), where the electric field of the $HEE_{11}$ mode is minimum, the loss tangent of the adhesive layers $L_1$ and $L_2$, which holds the three discs together, has little effect on the loss performance of the resonator.

Figure 8:
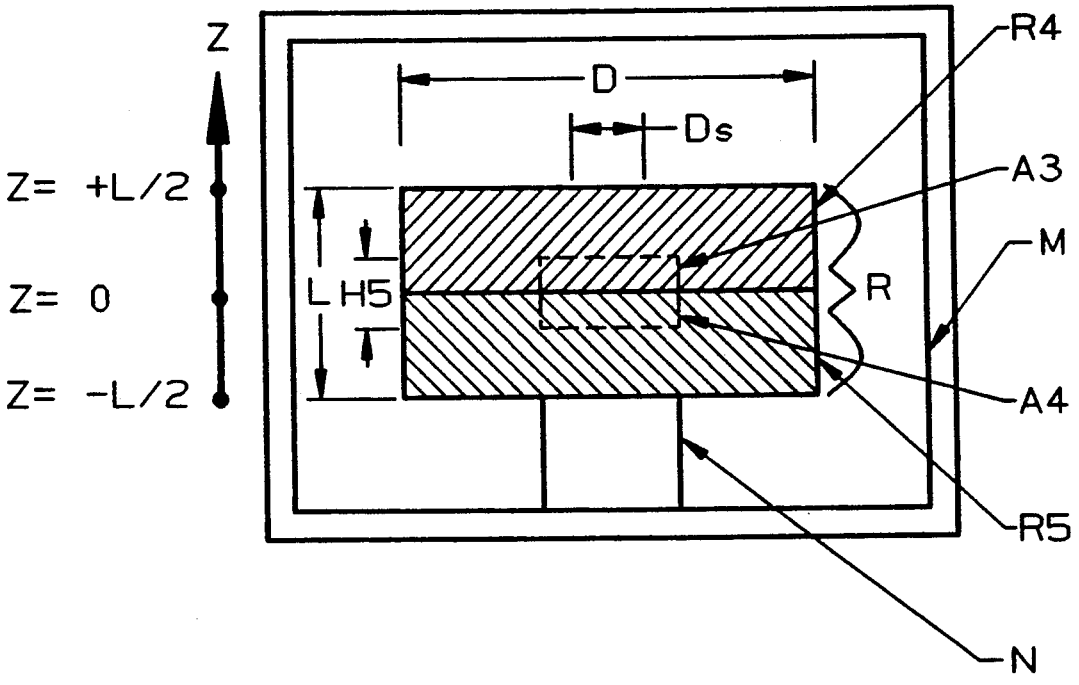
FIG. 8 is a partial sectional side view of a dielectric resonator having two discs with a centrally located aperture on an inner surface of each disc.

FIG. 8 illustrates a dielectric resonator which functions in a similar manner as the dielectric resonator disclosed in FIG. 7. The resonator has two identical dielectric discs $R_4$, $R_5$ having blind apertures $A_3$, $A_4$ attached together by a bonding material. The aperture may be of cylindrical shape or any other desired shape. It may be filled partially or totally with dielectric material of lower dielectric constant. In both of FIGS. 7 and 8, the dielectric resonator is mounted on a support N and is accommodated in a metallic enclosure M. Since the electric field of the $TEH_{01}$ mode is zero at r=0, the apertures in the disclosed resonator given in FIGS. 7 and 8 have a negligible effect on the separation between the resonant frequency of the $TEH_{01}$ mode and the operating $HEE_{11}$ mode.

Figure 9:
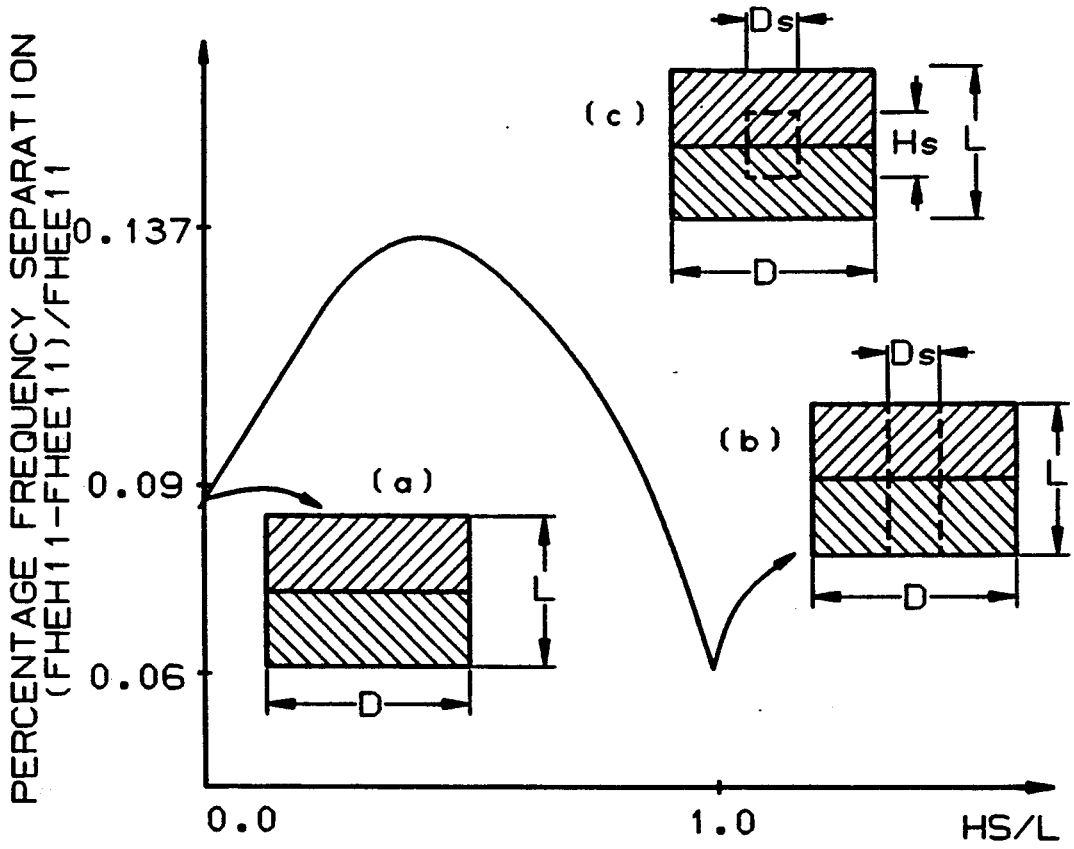
FIG. 9 is a graph illustrating the spurious performance of the dielectric resonator configurations shown.

FIG. 9 illustrates the measured percentage frequency separation between the $HEE_{11}$ and $HEH_{11}$ modes for the two-disc resonator configuration given in FIG. 8, wherein D=17.8 mm, L=10.9 mm and Ds=5.0 mm. In this example, the D/L ratio is chosen such that the first three consecutive resonant modes are $TEH_{01}$, $HEE_{11}$ and $HEH_{11}$. From FIG. 9, it can be seen that a larger percentage frequency separation between the operating $HEE_{11}$ and the spurious $HEH_{11}$ is achieved by the proposed two-disc resonator. With the choice of the optimum values of Hs and Ds, more than 50% improvement can be achieved in the percentage frequency separation between these two modes.

Figure 10:
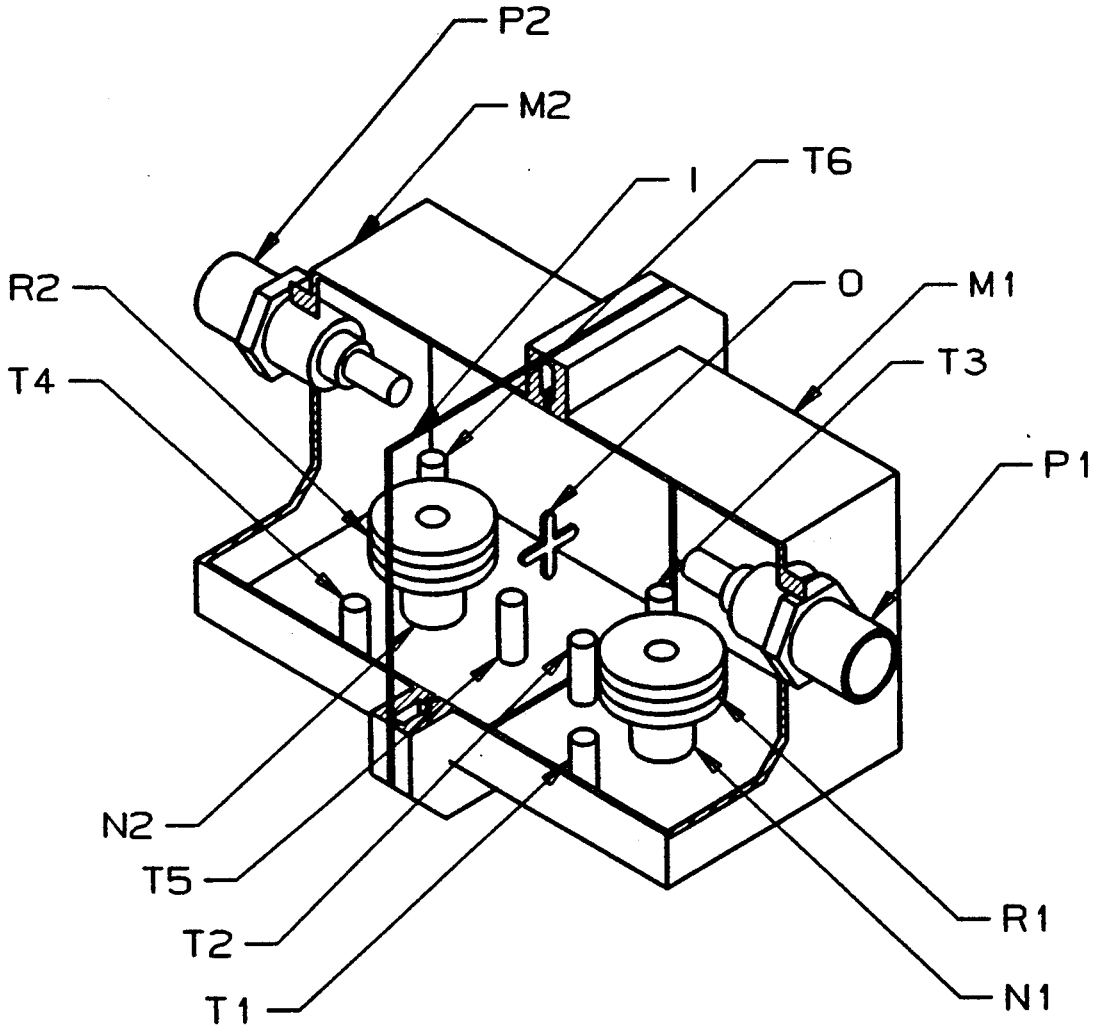
FIG. 10 is a perspective view illustrating the use of one of the disclosed dielectric resonator configurations in a dual-mode filter.

By way of example, FIG. 10 shows a 4-pole dual-mode filter employing the dielectric resonator configuration disclosed in FIG. 3. The filter comprises of two cavities $M_1$, $M_2$ and an iris I. The dimensions of the cavities $M_1$ and $M_2$ are arranged to be below cutoff for waveguide modes over the frequency range of interest. The cavity $M_1$ contains a dielectric resonator $R_1$, two tuning screws $T_1$, $T_2$, a coupling screw $T_3$ and a coaxial probe $P_1$. The dielectric resonator is operating in the dual $HEH_{11}$ mode and is mounted inside the cavity by a support $N_1$. The coupling between the two orthogonal $HEH_{11}$ modes is achieved by the screw $T_3$, which is located at 45° and 135° with respect to the tuning screws $T_2$ and $T_1$. The function of the coaxial probe is to couple electromagnetic energy into the filter or out of the filter. The cavity $M_2$ is nearly identical to the cavity $M_1$. It contains a dielectric resonator $R_2$, two tuning screws $T_4$ and $T_5$, a coupling screw $T_6$ and a coaxial probe $P_2$. The iris I provides intercavity coupling through the aperture O. The two cavities $M_1$ and $M_2$ and the iris I are bolted together by screws (not shown) to construct the filter. While the filter has two physical cavities, due to the dual-mode operation of the dielectric resonator, there are four electrical cavities whose resonance frequencies are controlled by the tuning screws $T_1$, $T_2$, $T_4$ and $T_5$.

FIG. 10 is included to illustrate the use of one of the resonators described in FIGS. 3, 4, 6, 7 and 8 in dual-mode filters and is not meant to limit the scope of the invention. It will be readily apparent to those skilled in the art that it will be possible to design a dual-mode filter, with any reasonable number of cavities, using any of the dielectric resonators included within the scope of the claims. Such a filter will have an improved spurious performance as compared to prior art.

It is to be noted that the dielectric discs illustrated in FIGS. 2 and 6 can be attached together by a bonding material or can be laminated in the axial direction. Although the present invention has been fully described by way of example in connection with a preferred embodiment thereof, it should be noted that various changes and modifications will be apparent to those skilled in the art. By way of example, the support structure is not restricted to the planar configurations described above. Other configurations, for example, mounting on microstrip substrates or mounting the resonators axially in cylindrical cavities could be utilized.

What I claim as my invention is:

1. A dual-mode filter comprising at least one cavity resonating in a dual-mode, said at least one cavity containing a dielectric resonator, said resonator containing at least one aperture, said at least one aperture extending partially through said resonator and being sized and located to shift a resonance frequency of a spurious mode to a higher frequency range distance from a principal mode.

2. A filter as claimed in claim 1 wherein the resonator is formed from at least two dielectric discs that are attached to one another.

3. A filter as claimed in claim 1 wherein the resonator is a solid cylindrical block with two blind apertures machined at a top and bottom face thereof.

4. A filter as claimed in claim 2 wherein the at least one cavity resonates in a dual $HEH_{11}$ mode and the spurious mode is an $HEE_{11}$ mode.

5. A filter as claimed in claim 4 wherein a ratio of frequency separation between the principal $HEH_{11}$ mode and the spurious $HEE_{11}$ mode obtained in said at least one cavity relative to that attained by a dual-mode cavity having a solid resonator without any aperture is greater than approximately 1.3.

6. A filter as claimed in claim 5 wherein apertures are located at a top and bottom of said dielectric discs substantially at a center thereof.

7. A filter as claimed in claim 6 wherein the resonator has three dielectric discs.

8. A filter as claimed in claim 3 wherein the at least one cavity resonates in a dual $HEH_{11}$ mode and the spurious mode is an $HEE_{11}$ mode.

9. A filter as claimed in claim 1 wherein the at least one cavity resonates in a dual $HEE_{11}$ mode and said resonator is formed from at least two dielectric discs attached together, said discs being arranged so that a resonance frequency of a spurious $HEH_{11}$ mode is shifted to a higher frequency zone away from said $HEE_{11}$ mode.

10. A filter as claimed in claim 9 wherein a ratio of frequency separation attained by said at least one cavity relative to that attained by a solid dielectric resonator without any aperture is greater than approximately 1.5.

11. A filter as claimed in claim 9 wherein the dielectric resonator has three discs and a middle disc contains an aperture.

12. A filter as claimed in claim 4 wherein one of said two discs being an upper disc and the other of said disc being a lower disc, the upper disc having a blind aperture in a bottom surface and the lower disc having a blind aperture in its upper surface.

13. A filter as claimed in any one of claims 2, 4 or 6 wherein the dielectric discs are attached together by a bonding material.

14. A filter as claimed in claim 2 wherein the dielectric discs are laminated in an axial direction.

15. A filter as claimed in any one of claims 1, 2 or 3 wherein said at least one aperture is at least partially filled with a dielectric material of a lower dielectric constant than a remainder of said resonator.

16. A filter as claimed in any one of claims 2, 3 or 4 wherein said resonator is supported inside a metallic enclosure by a dielectric support having a smaller dielectric constant than said resonator.

* * * * *